US008497815B2

(12) United States Patent
Leisten

(10) Patent No.: US 8,497,815 B2
(45) Date of Patent: Jul. 30, 2013

(54) DIELECTRICALLY LOADED ANTENNA AND AN ANTENNA ASSEMBLY

(75) Inventor: Oliver Paul Leisten, Raunds (GB)

(73) Assignee: Sarantel Limited, Wellingborough (GB)

( * ) Notice: Subject to any disclaimer, the term of this patent is extended or adjusted under 35 U.S.C. 154(b) by 1277 days.

(21) Appl. No.: 11/998,471

(22) Filed: Nov. 28, 2007

(65) Prior Publication Data

US 2008/0136738 A1 Jun. 12, 2008

Related U.S. Application Data

(60) Provisional application No. 60/861,845, filed on Nov. 29, 2006.

(30) Foreign Application Priority Data

Nov. 28, 2006 (GB) ..... 06237747.7

(51) Int. Cl.
*H01Q 1/36* (2006.01)

(52) U.S. Cl.
USPC ..... 343/895; 343/850; 343/865

(58) Field of Classification Search
USPC ..... 343/895, 850, 865
See application file for complete search history.

(56) References Cited

U.S. PATENT DOCUMENTS

| | | | | |
|---|---|---|---|---|
| 5,346,300 | A | 9/1994 | Yamamoto et al. | |
| 5,854,608 | A | 12/1998 | Leisten | |
| 5,859,621 | A | 1/1999 | Leisten | |
| 5,945,963 | A | 8/1999 | Leisten | |
| 5,963,180 | A | 10/1999 | Leisten | |
| 6,369,776 | B1 | 4/2002 | Leisten | |
| 6,501,437 | B1 | 12/2002 | Gyorko et al. | |
| 6,552,693 | B1 | 4/2003 | Leisten | |
| 2002/0018026 | A1 * | 2/2002 | Noro | 343/895 |
| 2005/0195126 | A1 | 9/2005 | Leisten | |
| 2006/0017633 | A1 * | 1/2006 | Pronkine | 343/729 |

(Continued)

FOREIGN PATENT DOCUMENTS

| | | |
|---|---|---|
| DE | 102004040258 | 2/2006 |
| EP | 0169823 | 1/1986 |

(Continued)

OTHER PUBLICATIONS

International search report GB0723236, date of search of the international search report—Mar. 28, 2008.

(Continued)

*Primary Examiner* — Dieu H Duong
(74) *Attorney, Agent, or Firm* — John Bruckner PC

(57) ABSTRACT

A dielectrically loaded quadrifilar helical antenna has four quarter turn helical elements centered on a common axis. Each helical element is metallised on the outer cylindrical surface of a solid dielectric core and each has a feed end and a linked end, the linked ends being connected together by a linking conductor encircling the core. At an operating frequency of the antenna the helical elements and the linking conductor together form two conductive loops each having an electrical length in the region of (2n−1)/2 times the wavelength, where n is an integer. Such an antenna tends to present a source impedance of at least 500 ohms to receiver circuitry to which it is connected. The invention includes an antenna assembly including a dielectrically antenna and a receiver having a radio frequency front-end stage with a differential input coupled to the feed ends of the helical elements.

47 Claims, 4 Drawing Sheets

U.S. PATENT DOCUMENTS

| | | | |
|---|---|---|---|
| 2006/0038739 | A1 | 2/2006 | Feng et al. |
| 2006/0082517 | A1 | 4/2006 | Chung et al. |
| 2006/0097950 | A1 | 5/2006 | Leisten |
| 2007/0063902 | A1 | 3/2007 | Leisten |
| 2007/0063919 | A1 | 3/2007 | Leisten |

FOREIGN PATENT DOCUMENTS

| | | |
|---|---|---|
| GB | 2309592 | 7/1997 |
| GB | 2317057 | 3/1998 |
| GB | 2346014 | 7/2000 |
| GB | 2351850 | 1/2001 |
| GB | 2383901 | 7/2003 |
| GB | 2420230 | 5/2006 |
| GB | 2437998 | 11/2007 |
| JP | 4-026203 | 1/1992 |
| JP | 5-14043 | 1/1993 |
| WO | WO 98/44590 | 10/1998 |
| WO | WO 03/044894 | 5/2003 |
| WO | WO 2006/011723 A1 | 2/2006 |
| WO | WO 2006/015250 | 2/2006 |
| WO | WO 2006/051257 | 5/2006 |

OTHER PUBLICATIONS

Search Report from GB 0623774.7, Mar. 16, 2007.

Search Report from GB 0723236.6, search dated Nov. 25, 2010.

Search Report from GB 0723236.6, Nov. 25, 2010.

Office action from Japanese patent application 2009-538772 dated Jun. 20, 2012.

* cited by examiner

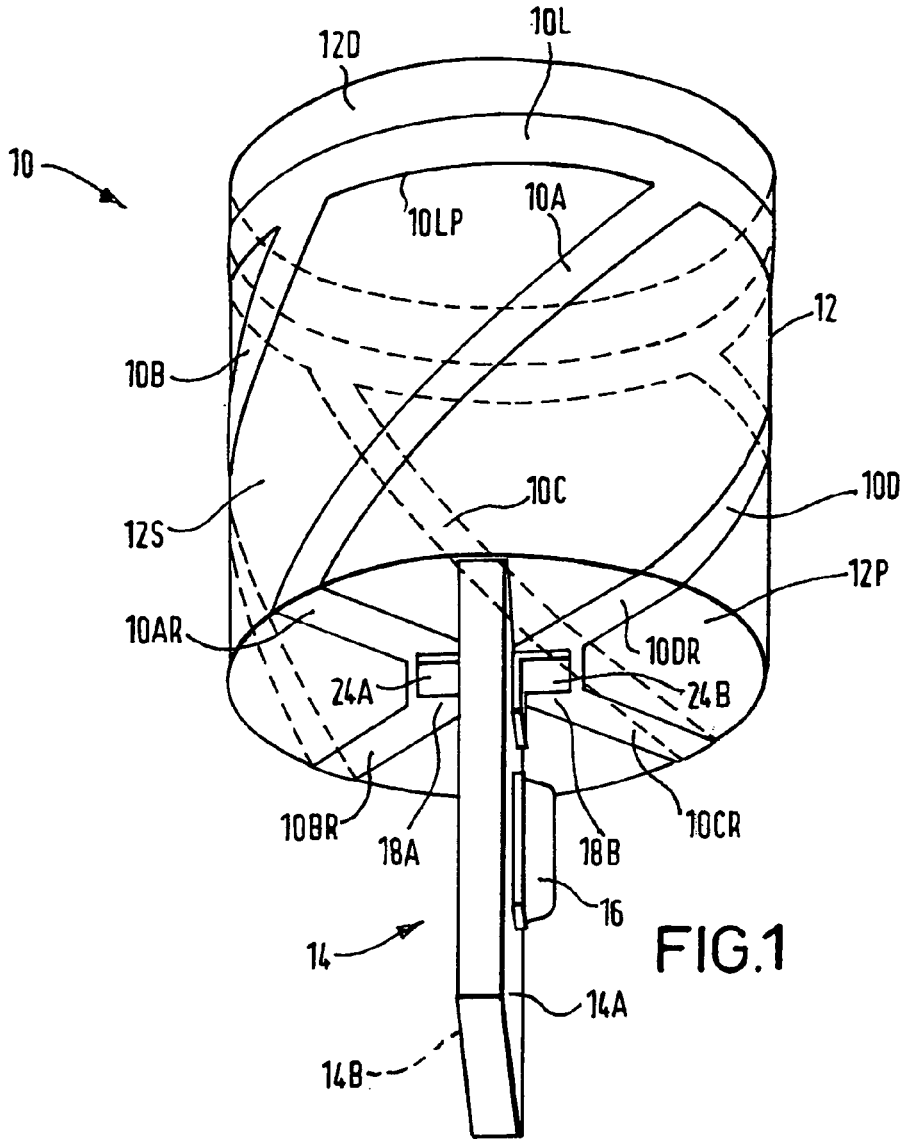
FIG.1
FIG.2
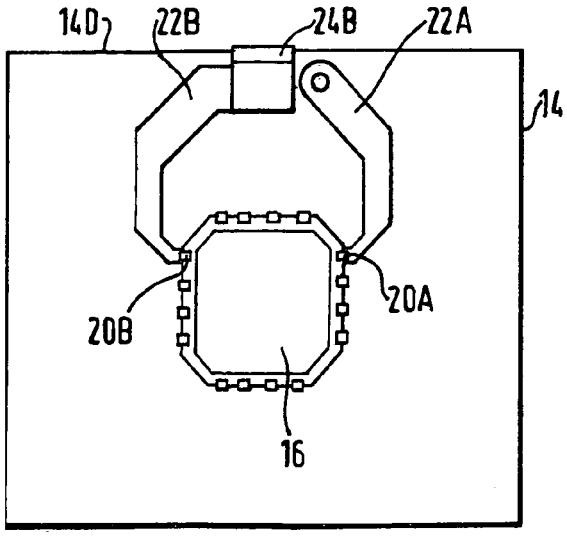
FIG.3
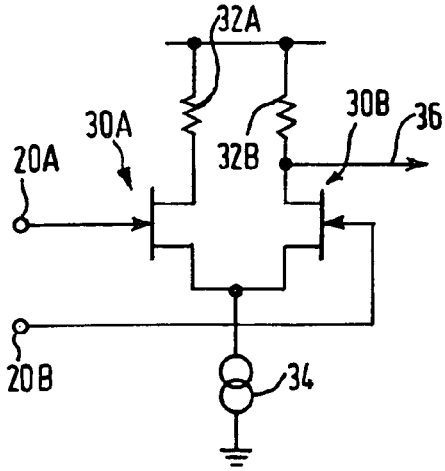

DIELECTRICALLY LOADED ANTENNA AND AN ANTENNA ASSEMBLY

CROSS-REFERENCES TO RELATED APPLICATIONS

This application claims a benefit of priority under 35 U.S.C. 119(e) from provisional patent application U.S. Ser. No. 60/861,845, filed Nov. 29, 2006, the entire contents of which are hereby expressly incorporated herein by reference for all purposes. This application is related to, and claims a benefit of priority under one or more of 35 U.S.C. 119(a)-119(d) from copending foreign patent application 0623774.7, filed in the United Kingdom on Nov. 28, 2006 under the Paris Convention, the entire contents of which are hereby expressly incorporated herein by reference for all purposes.

FIELD OF THE INVENTION

This invention relates to a dielectrically loaded antenna and to an antenna assembly including such an antenna. The invention is particularly applicable to an antenna for operation at a frequency in excess of 200 MHz, the antenna being dielectrically loaded by a solid dielectric core and having a three-dimensional antenna element structure disposed on or adjacent an outer surface of the core. The antenna assembly includes a radio frequency front-end stage coupled to the antenna.

BACKGROUND OF THE INVENTION

Such an antenna is disclosed in numerous patent publications of the applicant, including U.S. Pat. Nos. 5,854,608, 5,945,963, 5,859,621, and 6,552,693. These patents disclose antennas each having one or two pairs of diametrically opposed helical antenna elements which are plated on a substantially cylindrical electrically insulative core of a material having a relative dielectric constant greater than 5, with the material of the core occupying the major part of the volume defined by the core outer surface. In each case, the antenna has a feed structure extending axially through the core. A trap in the form of a conductive sleeve encircles part of the core and connects to the feed structure at one end of the core. At the other end of the core, the antenna elements are each connected to the feed structure. Each of the antenna elements terminates on the rim of the sleeve and each follows a respective longitudinally extending path. In the antenna disclosed in the applicant's U.S. Pat. No. 6,369,776, the feed structure, which is a coaxial transmission line, is housed in an axial passage through the core. The diameter of which passage is greater than the outer diameter of the coaxial line. The outer shield conductor of the coaxial line is thereby spaced from the wall of the passage. This has the effect of reducing parasitic resonances. U.S. Pat. No. 5,963,180 discloses the combination of a quadrifilar dielectrically loaded antenna and a diplexer, the latter including an impedance matching network for matching the antenna to a 50 ohms load impedance at either output of the diplexer. U.S. patent application Ser. No. 11/060,215 shows how a cavity may be formed in a proximal end portion of the core to reduce the size and weight of a dielectrically loaded antenna. More complex structures are disclosed in U.S. patent application Ser. Nos. 11/088,247, 11/742,587, 11/263,643, 60/831,334, 60/920,607 and 60/921,108. The disclosure of each of the above patents and patent applications is explicitly incorporated in the present specification by reference.

SUMMARY OF THE INVENTION

According to a first aspect of the present invention, there is provided a dielectrically loaded multifilar helical antenna having at least two pairs of elongate conductive substantially helical antenna elements centred on a common axis, each of which elements has a feed end and a linked end, the linked ends of each pair being linked together by a linking conductor, wherein, at an operating frequency at which the antenna is resonant in respect of axially directed circularly polarised radiation, the helical elements of each of the said two pairs form part of a conductive loop having an electrical length of substantially $(2n-1)/2$ times the wavelength, where n is an integer. In the preferred antenna in accordance with the invention, each of the helical elements executes a quarter turn about the axis. The invention is primarily applicable to an antenna for operation at a frequency in excess of 200 MHz, the antenna including a dielectric core of a solid material having a relative dielectric constant greater than 5, the material of the core occupying the major part of the volume defined by the core outer surface, a three-dimensional antenna element structure disposed on or adjacent an outer surface of the core and having a balanced feed connection. Typically a balanced feed structure extends from the feed connection to, for instance, a termination intended to be coupled to a balanced circuit input, e.g. a differential amplifier. The feed structure may comprise a parallel pair of wires, a twisted pair of wires, or parallel printed tracks on the dielectric core or on a printed circuit board on which the amplifier is mounted.

In the case of the antenna being a backfire antenna, the feed structure may extend through the core in an axial passage. Typically, the feed structure has a characteristic impedance greater than 500 ohms. The antenna may, alternatively, be an endfire antenna.

According to a second aspect of the invention, an antenna assembly includes a dielectrically loaded antenna as described above and a receiver having a radio frequency (RF) front-end stage with a differential input coupled to the antenna, the input impedance of the differential input being at least 500 ohms. The front-end stage may be a differential amplifier on a printed circuit board, and this board may be secured on or adjacent a proximal or distal surface portion of the core extending transversely with respect to the axis, preferably perpendicularly with respect to the axis. The antenna may be mounted on the printed circuit board with one of its transversely extending surface portions abutting a major surface of the board. Alternatively, the antenna may be secured to one of the edges of the board with the board extending in a plane which contains the axis of the core or which is parallel to the axis of the core. The board may, therefore, depend from a proximal end surface portion of the core.

The preferred antenna has a cylindrical core with a cylindrical side surface portion extending between the proximal and distal surface portions, the latter extending substantially perpendicularly to the above-mentioned common axis. The core may have a cavity the base of which forms the proximal surface portion, the cavity receiving the radio frequency front-end stage.

Since the feed structure may form part of the resonant structure of the antenna, it is preferably kept short, the differential amplifier being mounted close to the antenna. In the case of the core having a cavity with the amplifier mounted in the cavity, the feed structure can be particularly short. In other embodiments, a differential amplifier is mounted on a printed circuit board attached to an end face of the antenna with the amplifier within 10 mm of the proximal surface portion of the core. In some preferred embodiments, the differential amplifier is mounted with its differential input terminals within 5 mm of the proximal surface portion of the antenna core. To reduce coupling between, on the one hand, the antenna, its feeder structure and the differential amplifier and, on the other hand, radio frequency equipment to which the assembly is electrically connected, the assembly may include a conductive enclosure mounted to the core or to the printed circuit board and containing the differential amplifier. Typically, the differential amplifier has a single-ended output connection which is located inside the enclosure.

The combination of a dielectrically-loaded antenna having a balanced feed connection and a differential amplifier as described above offers the possibility of a comparatively simple assembly which is easily matched in impedance terms. Indeed, in the preferred embodiments of the invention, the feed connection can be connected directly to input terminals of the differential amplifier without reactive matching components. A particularly economical assembly is realised if the differential amplifier forms part of an integrated receiver chip which may, for instance, include not only a long-tailed pair front end amplifier, but also at least one mixer stage, at least one intermediate frequency (i.f.) stage, a demodulator or decoder, and signal processing stages. Such an assembly may be used for Global Positioning System (GPS) signal reception and processing, in which case the antenna is preferably a quadrifilar helical antenna, and, in addition, Wi-Fi and Bluetooth transceivers, as well as for transceivers for GSM and 3G cellphones, for instance.

As an alternative to a differential amplifier, the RF front-end stage may be a monolithic filter element such as a surface acoustic wave (SAW) filter having a balanced input, the element being mounted on or close to the antenna core. The input impedance of the filter element is typically 600 ohms or higher. The output impedance is typically 50 ohms, although a higher output impedance is feasible. The output is advantageously single-ended, the filter element acting as a balun.

According to another aspect of the invention, an antenna assembly for operation at a frequency in excess of 200 MHz includes a dielectrically loaded antenna that comprises a dielectric core of a solid material having a relative dielectric greater than 5 and a three-dimensional antenna element structure disposed on or adjacent an outer surface of the core, as well as a balanced feed connection and a differential amplifier coupled to the feed connection. The antenna element structure comprises at least one pair of laterally opposed elongate helical conductive antenna elements each having a first end terminating in the feed connection and a second end coupled to the second end of the other antenna element of the pair such that the pair of antenna elements forms part of a loop. The electrical length of the loop is in the region of $(2n-1)/2$ times the wavelength at the operating frequency, where n is an integer. In the preferred antenna, the electrical length of the loop is about a half wavelength (i.e. 180° in phase terms) and the helical elements are each quarter-turn helices. The source resistance presented to the differential amplifier input by the antenna and its feed structure is typically at least 500 ohms and, preferably, greater than 1 kilohm.

According to a third aspect of the invention, there is provided an antenna assembly including a dielectrically-loaded antenna as described above and a differential amplifier coupled to the antenna wherein: the antenna comprises a dielectric core of a solid material having a relative dielectric constant greater than 15, the said antenna elements having a common axis and being axially coextensive on or adjacent an outer surface of the core; the antenna further comprises a feed connection having a pair of feed connection nodes each coupled to a respective one or more of the antenna elements at their feed ends; and the differential amplifier has a differential input with a pair of input terminals each of which is coupled to a respective one of the feed connection nodes. Again, a SAW filter element may be used in place of a differential amplifier, the filter element having a balanced input with a pair of input terminals each of which is coupled to a respective one of the feed connection nodes of the antenna. The filter characteristic is preferably a bandpass filter. Other filter characteristics are feasible. Whether a bandpass filter characteristic or a different characteristic is used, the filter element, when combined with or forming part of a radio receiver, is advantageously tuned to reject signals at the image frequency associated with a mixer stage of the receiver downstream of the filter element. A monolithic ceramic SAW filter is particularly appropriate.

In the case of the antenna being a backfire antenna, the core typically has a passage extending therethrough from the distal core surface portion to the proximal core surface portion, the feed connection nodes being associated with the distal surface portion. A parallel pair of conductors extends through the passage from the feed connection nodes to differential input terminals of the differential amplifier or the input terminals of a balanced input SAW filter.

The above-mentioned feed connection nodes are preferably located on or adjacent the common axis and on an outer surface portion of the core, the antenna elements being helical conductors coupled to the feed connection nodes by respective radial conductors on the outer surface portion of the core. Alternatively, the feed connection nodes may be located on the printed circuit board on or adjacent the common axis, the helical conductors being coupled to the feed connection nodes by conductors on the board.

In preferred embodiments of the invention, the helical conductors each have one end coupled to one or other of the feed connection nodes and an opposite end coupled to a linking conductor. The helical conductors and the linking conductor together form part of at least one conductive loop that extends from one feed node to the other feed node and has an electrical length of $(2n-1)/2$ times the wavelength at the operating frequency, where n is an integer.

Each of the helical conductors executes $(2P-1)/4$ turns around the common axis, where P is an integer.

The source impedance typically presented to the input of the differential amplifier or SAW filter element is greater than or equal to 500 ohms, and is preferably a balanced source. The amplifier or filter element preferably has a single-ended output.

The antenna forming part of the antenna assembly in at least some embodiments of the invention is a quadrifilar antenna having four quarter-turn helical conductors each centred on the common axis. Alternatively, the antenna may be a bifilar antenna having two quarter-turn helical conductors.

The invention will be described below by way of example with reference to the drawings.

BRIEF DESCRIPTION OF THE DRAWINGS

In the drawings:

FIG. 1 is a perspective view of a first antenna assembly in accordance with the invention, including a dielectrically loaded endfire quadrifilar antenna viewed from one side and from a proximal end;

FIG. 2 is a diagrammatic plan view of a printed circuit board bearing a differential amplifier, forming part of the assembly of FIG. 1;

FIG. 3 is a simplified circuit diagram of the differential amplifier;

DETAILED DESCRIPTION OF PREFERRED EMBODIMENTS OF THE INVENTION

Figure 4:
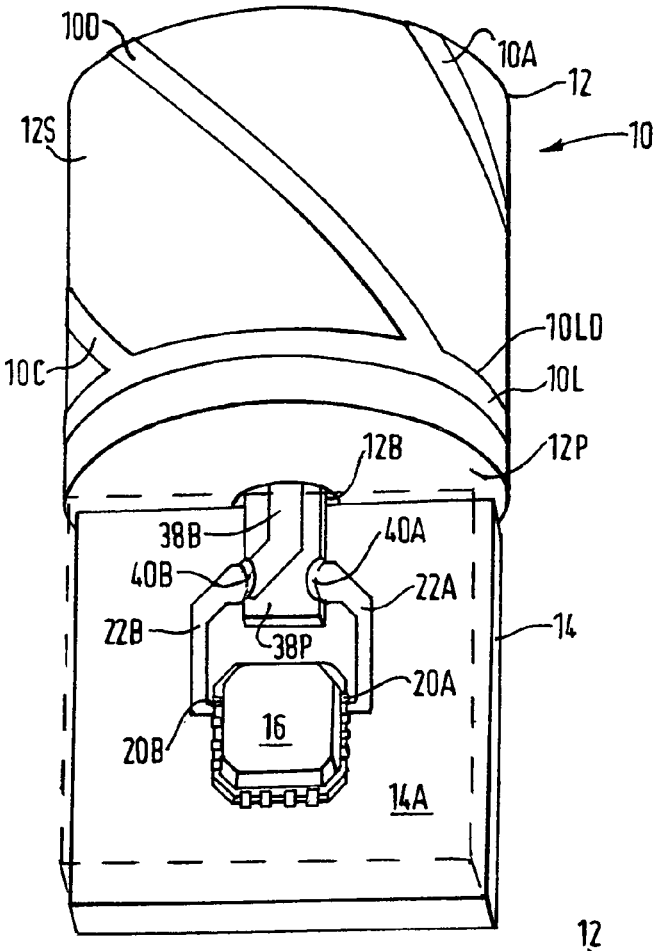
FIG. 4 is a perspective view of a second antenna assembly in accordance with the invention, including a dielectrically-loaded backfire antenna viewed from one side and from a proximal end, together with a printed circuit board bearing a differential amplifier.

Referring to FIGS. 1 and 2, a first antenna assembly in accordance with the invention comprise an endfire dielectrically-loaded quadrifilar antenna 10 having a cylindrical dielectric core 12, and a printed circuit board 14 attached to a proximal end surface portion 12P of the core, the board 14 carrying a differential amplifier chip 16 on one major face 14A thereof.

The dielectrically-loaded antenna 10 has an antenna element structure with four axially coextensive quarter-turn helical tracks 10A, 10B, 10C and 10D plated on a cylindrical outer side surface portion 12S of the core 12.

The cylindrical side surface portion 12S of the core defines a central axis (not shown) of the antenna and the helical elements 10A-10D each follow respective helical paths which are helices having this axis as their axis of rotation. The proximal core surface portion 12P extends perpendicularly with respect to the axis and the side surface portion 12S. This forms an end face of the antenna. The other end of the antenna is formed by a distal surface portion 12D of the core which also extends perpendicularly to the antenna axis and forms another end face of the antenna.

Encircling the core 12 adjacent the distal surface portion 12D is an annular linking conductor 10L, also formed as a track on the cylindrical side surface portion 12S. The linking conductor 10L is spaced from the edge of the cylindrical side surface portion which bounds the distal surface portion 12D.

The helical conductors 10A-10D are substantially uniformly distributed around the cylindrical surface portion 12S of the core and each extends to a proximal edge of the cylindrical side surface portion where it is connected to a respective radial conductor 10AR, 10BR, 10CR, or 10DR which are formed as tracks on the proximal surface portion 12P. Two of the radial conductors 10AR, 10BR are connected together in a central region of the proximal surface portion 12P to form a first feed connection node 18A. Likewise, the other two radial conductors 10CR, 10DR are connected together in the central region to form a second feed conductor node 18B. It will be seen that the combination of the helical conductors 10A-10D, their corresponding radial conductors 10AR-10DR, and the linking conductor 10L, together form two looped conductive paths extending from the first connection node 18A to the second connection node 18B. Each looped path comprises one pair of laterally opposed helical elements 10A, 10C; 10B, 10D, the corresponding radial conductors 10AR, 10CR; 10BR, 10DR, and a semicircular portion of the linking conductor 10L.

The printed circuit board 14 is secured edgewise (by is distal edge 14D) to the proximal end of the antenna 10 with the board extending generally axially from the antenna and at a rotational position such that the combination of the radial conductors 10AR, 10BR associated with the first feed connection node 18A and the combination of the radial conductors 10CR, 10DR associated with the second feed connection node 18B extend on opposite sides of the board 14 in symmetry. In other words, the board 14 bisects the angles made between neighbouring radial conductors 10AR, 10DR; 10BR, 10CR of the interconnected pairs, as shown in FIG. 1. The integrated circuit 16 containing a differential amplifier is, in this embodiment, surface-mounted on one face 14A of the board 14. Referring to FIG. 2, the integrated circuit 16 has two differential input terminals 20A, 20B connected directly to the respective feed connection nodes 18A, 18B. The terminals 20A, 20B are soldered to symmetrically arranged feeder tracks 22A, 22B which, adjacent the distal edge 14D of the board 14 are connected to conductive brackets 24A, 24B mounted on opposite faces 14A, 14B of the board 14, each bracket having an upstanding arm one face of which is generally flush with or slightly proud of the distal edge 14. Connection of the input terminal 20B to one of the conductive brackets 24B is made directly via the feeder track 22B, to which the respective bracket 24B is soldered. As for the connection to input terminal 20A, the corresponding feeder track 22A is coupled to the other conductive bracket 24A through a plated hole ("via") 26 which connects the feeder track 22A to a short track (not shown) on the other face 14B of the board 14, to which the other conductive bracket 24A is soldered.

It follows that the combination of the feeder conductors 22A, 22B, the associated connections to the feed connection nodes 18A, 18B, and the above-described conductive tracks plated on the core 12 provide two conductive loops for radio frequency currents, each extending from the first differential input terminal 20A of the integrated circuit 16 via feeder track 22A and returning via feeder track 22B to the other differential input terminal 20B.

Although it is not apparent from FIG. 1, the proximal edge 10LP of the linking conductor L does not follow a simple circular path in a single transverse plane. As in previous dielectrically-loaded quadrifilar antennas disclosed in some of the prior patents referred to above, the edge of the linking conductor is slightly inclined between the junctions of the linking conductor 10L with the distal ends of the helical conductors 10A-10B in such a way that the elements of one pair 10B, 10D are longer than those of the other pair 10A, 10C. In particular, where the shorter elements 10A, 10C are connected to the linking conductor 10L, the proximal edge 10LP is a little nearer the proximal surface portion 12P of the core than where the longer antenna elements 10B, 10D are connected to the linking conductor 10L. It follows that the conductive loops are of different lengths. This has the effect of creating a mode of resonance for circularly polarised radiation emanating from a source on the antenna axis, in which the current on each helical track 10A, 10B, 10C, 10D is 90° out of phase with the current on the neighbouring helical track. In this respect, the antenna exhibits a "quadrifilar" mode of resonance similar to that of known quadrifilar helical antennas. However, in this case, each conductive loop referred to above is approximately a half wavelength at the operation frequency of the antenna, which means that voltage maxima occur at or near the feed connection nodes 18A, 18B. Current maxima for each loop occur on the linking conductor 10L approximately midway between the respective connections thereto of the relevant helical elements 10A, 10C; 10B, 10D (these connections being diametrically opposed on the linking conductor 10L). The precise location of the voltage maxima at the operation frequency depends on, inter alia, the lengths of the feeder tracks 22A, 22B which form parts of the resonant loops.

The presence of voltage maxima at or near the feed connection nodes, as described, implies that the source impedance represented by the antenna 10 in the quadrifilar mode of resonance is comparatively high, typically in the order of several kilohms. Owing to the substantially symmetrical nature of the conductive elements forming the conductive loops, the voltage output of the antenna is a balanced output. To match this high-impedance balanced output characteristic of the antenna, the amplifier contained in the integrated circuit chip 16 is a high input impedance differential amplifier having, as its input stage, a long-tailed pair of transistors 30A, 30B, as shown in FIG. 3. In this instance, the transistors forming the long-tailed pair are CMOS field-effect transistors which, in a conventional way, have equal drain resistances 32A, 32B and interconnected source terminals coupled to a constant current source 34. The differential input terminals of the circuit 20A, 20B are connected to respective gate terminals of the transistors 30A, 30B and a single-ended output 36 is taken from one of the drain terminals. The differential amplifier therefore acts as a balun. Although the differential amplifier described above with reference to FIG. 3 is described only to the extent of a long-tailed input pair, it should be noted that, in general, this is a simplified representation. As known to those skilled in the art, a typical integrated circuit differential amplifier has further stages and additional transistors.

The printed circuit layout shown in FIG. 2 is also a simplified representation. It will be understood that, in practice, the board 14 has additional printed tracks for connection to the other terminals of the integrated circuit 16 and, typically, has a ground plane covering much of the reverse face 14B. Depending on the nature of the equipment within which the antenna assembly is incorporated, a conductive enclosure may be mounted to the top face 14A of the board 14A as a screen to minimise coupling between the feeder tracks 22A, 22B and sources of interference within the equipment. This is especially desirable if good common-mode isolation of the antenna is required.

With regard to the antenna core, the preferred core material is a zirconium-tin-titananate based ceramic material. This material has a relative dielectric constant of 36 and is noted, also, for its dimensional and electrical stability with varying temperature. Its dielectric loss is negligible. The core may be produced by extrusion or pressing.

The antenna may have other features in common with the antennas disclosed in the above-mentioned prior British patents, the entire disclosures of which are incorporated in the present application by reference.

The diameter of the core of the antenna in this first preferred embodiment is 10 mm, the quadrifilar resonant frequency being 1575.42 MHz, i.e. the centre frequency of the GPS L1 band.

Depending on the housing afforded by the equipment in which the antenna assembly is mounted, the securing of the printed circuit board 14 to the antenna 14 with the distal edge 14D of the board abutting the proximal end face of the antenna may be supplemented by an insulative collar (not shown). This collar may be made, as known, from plastics material having a low relative dielectric constant. Typically, the collar encircles a proximal end portion of the core and has proximally extended jaws which receive the printed circuit board 14 therebetween.

Figure 5:
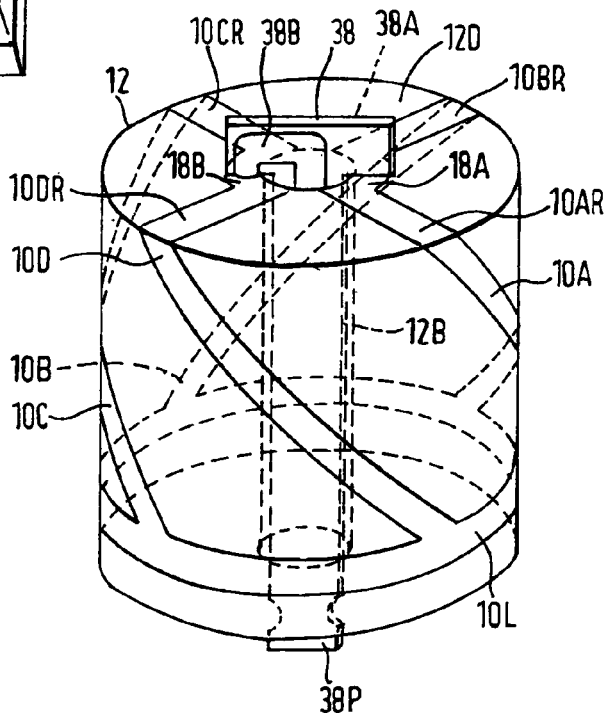
FIG. 5 is a perspective view of the antenna shown in FIG. 4, viewed from one side and showing a distal end of the antenna.

Referring now to FIGS. 4 and 5, a second antenna assembly in accordance with the invention has a backfire antenna 10 with four substantially uniformly distributed helical radiating elements 10A-10D, as in the first embodiment of the invention. In this case, however, feed connection nodes 18A, 18B are provided in the central region of the distal surface portion 12D of the core 12. These nodes 18A, 18B are provided at the interconnections of, respectively, radial tracks 10AR, 10BR of a first pair and radial tracks 10CR, 10DR of a second pair, plated on the distal surface portion 12D. As before, each helical element 10A-10D has one end coupled to a respective radial conductor 10AR-10DR and another, opposite end coupled to an annular linking conductor 10L which, in this embodiment, encircles the core 12 adjacent to but spaced from the proximal surface portion 12P.

The core 12 has an axial bore 12B forming a passage which houses a parallel-pair feed structure in the form of a narrow, elongate printed circuit board 38 having a first track 38A (not visible in FIGS. 4 and 5) on one face and a second track 38B on the other face. These feeder tracks extend centrally on each respective face of the board 38 so as to be parallel to each other through the whole length of the bore 12B. Where the board 38 projects beyond the distal end of the core, each track 38A, 38B is looped over in a "hockey-stick" configuration on a projecting distal end portion of the feeder board 38 to form a soldered connection with a respective one of the feed connection nodes 18A, 18B. It will be noted that the feeder board 38 is oriented so to be axially located and rotationally positioned with the radial tracks of each pair 10AR, 10BR; 10CR, 10DR extending symmetrically on either side of the board, the board having lateral extensions which overlap the plated feed connection nodes 18A, 18B.

The feeder board 38 has a proximally projecting portion 38P which abuts a major face 14A of a printed circuit amplifier board 14. As in the first embodiment described above with reference to FIGS. 1 to 3, the board 14 bears a differential amplifier integrated circuit 16. In this case, however, owing to the axial location of the feeder board 38, the amplifier printed circuit board 14, although lying parallel to the axis of the antenna 10, is offset a little to one side. Again, as before, the distal edge 14D abuts or lies adjacent the proximal core surface portion 12P and may be secured by means of an insulative plastics collar as described above.

In common with the first embodiment, the amplifier board 14 has symmetrically arranged feeder tracks 22A, 22B soldered to differential input terminals 20A, 20B of the integrated circuit 16. In this case, the side edges of the proximal portion 38P of the feeder board 38 has plated recesses 40A, 40B on opposite side edges, the plating being connected respectively to the parallel pair conductors (only one of which, 38B, is shown), the arcuate plated surface of each recess 40A, 40B being connected to one of the feeder tracks 22A, 22B. It is in this way that the feeder board 38 and the amplifier board tracks 22A, 22B connect the plated tracks 10A-10D, 10AR-10DR on the core 12 to the differential input terminals 20A, 20B of the printed circuit chip 16.

The combination of the plated tracks and the feeder conductors form two conductive loops with resonant properties similar to those described with reference to the first embodiment.

As before, the linking conductor 10L has a non-planar edge 10LD in order that the helical elements are of different lengths, thereby yielding a "quadrifilar" resonance for circularly polarised radiation directed along the axis of the antenna.

As an alternative to mounting the differential amplifier on a printed circuit board attached to the antenna core so that it depends axially from the core, it may be mounted in a recess or cavity (not shown in the drawings) in the proximal end portion of the antenna. An antenna having a core with a suitable proximally directed cavity is disclosed in the applicant's British Patent Application No. 2420230. The cavity is of circular cross-section and coaxial with the cylindrical outer surface of the core.

The antenna assembly embodiments described above include a differential amplifier integrated circuit or receiver-on-chip integrated circuit mounted close to the antenna core. Other assemblies are possible within the scope of the invention. For instance, rather than using a differential amplifier connected directly to the antenna feed nodes or feed structure, an interface may be provided in the form of an integrated or monolithic surface acoustic wave (SAW) filter element having a balanced high-impedance (typically 600 ohms). Such elements are available with a balanced output. Alternatively, a SAW filter element with a single-ended output may be used, for feeding a single-ended RF amplifier. The frequency response of the filter is typically selected so as to reject the image frequency of the first mixer in the downstream RF circuitry.

As for the mounting of a SAW filter element, this may be achieved as described for a differential amplifier RF front-end stage, i.e. on a printed circuit board mounted to the proximal end portion of the antenna core. This may form part of an assembly which projects axially from the proximal end portion, or which is housed in a proximally directed cavity in the core.

Figure 6:
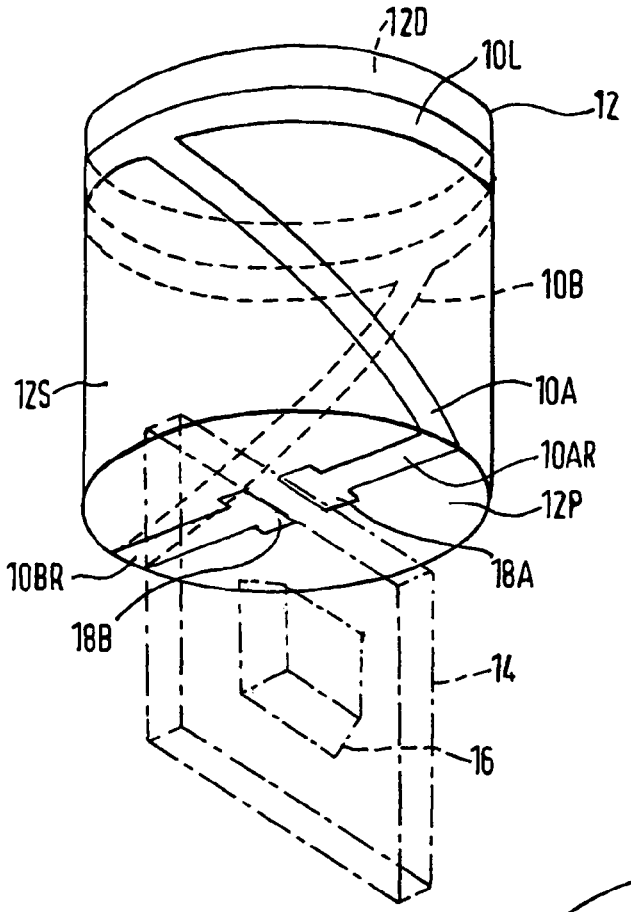
FIG. 6 is a perspective view of a dielectrically-loaded endfire bifilar antenna viewed from one side and from a proximal end, a printed circuit board bearing a differential amplifier being shown in chain lines as being secured to a proximal end of the antenna.

The embodiments so far described are intended for receiving circularly polarised radiation, generally transmitted from earth-orbiting satellites such as the satellites of the GPS constellation. The invention also encompasses within its scope antenna assemblies for receiving linearly polarised electromagnetic radiation more commonly used for terrestrial communication. Accordingly, a third antenna assembly in accordance with the invention has a dielectrically-loaded bifilar antenna, as shown in FIG. 6. Referring to FIG. 6, an endfire bifilar antenna has a single pair of laterally opposed quarter-turn helical elements 10A, 10B and respective radial conductors 10AR, 10BR plated on the proximal surface portion 12P of the core 12. As in the previous embodiments, there is a linking conductor 10L encircling the core 12 plated as an annular track on the cylindrical surface portion 12S at a location close to but spaced from a distal surface portion 12D of the core 12. Respective feed connection nodes 18A, 18B are provided as plated pads in a central region of the proximal surface portion 12P. It will be seen that the combination of the helical elements 10A, 10B, the respective connected radial conductors 10AR, 10BR, and the conductor 10L linking the other ends of the helical elements 10A, 10B together form a conductive loop providing a balanced feed at the feed connection nodes 18A, 18B. The conductive loop, whether formed by one semicircular portion of the linking conductor 10L interconnecting the helical elements 10A, 10B or the other semicircular portion, has an electrical length in the region of a half wavelength at an operating frequency of the antenna. Connections to a printed circuit board 14 bearing a differential amplifier 16 (both shown by phantom lines in FIG. 6, in this case) are made in the manner described above with reference to FIG. 2. This bifilar antenna has a generally toroidal radiation pattern similar to that shown in British Patent No. 2309592, with nulls directed substantially transversely with respect to the antenna axis and the radial conductors 10AR, 10BR.

Figure 7:
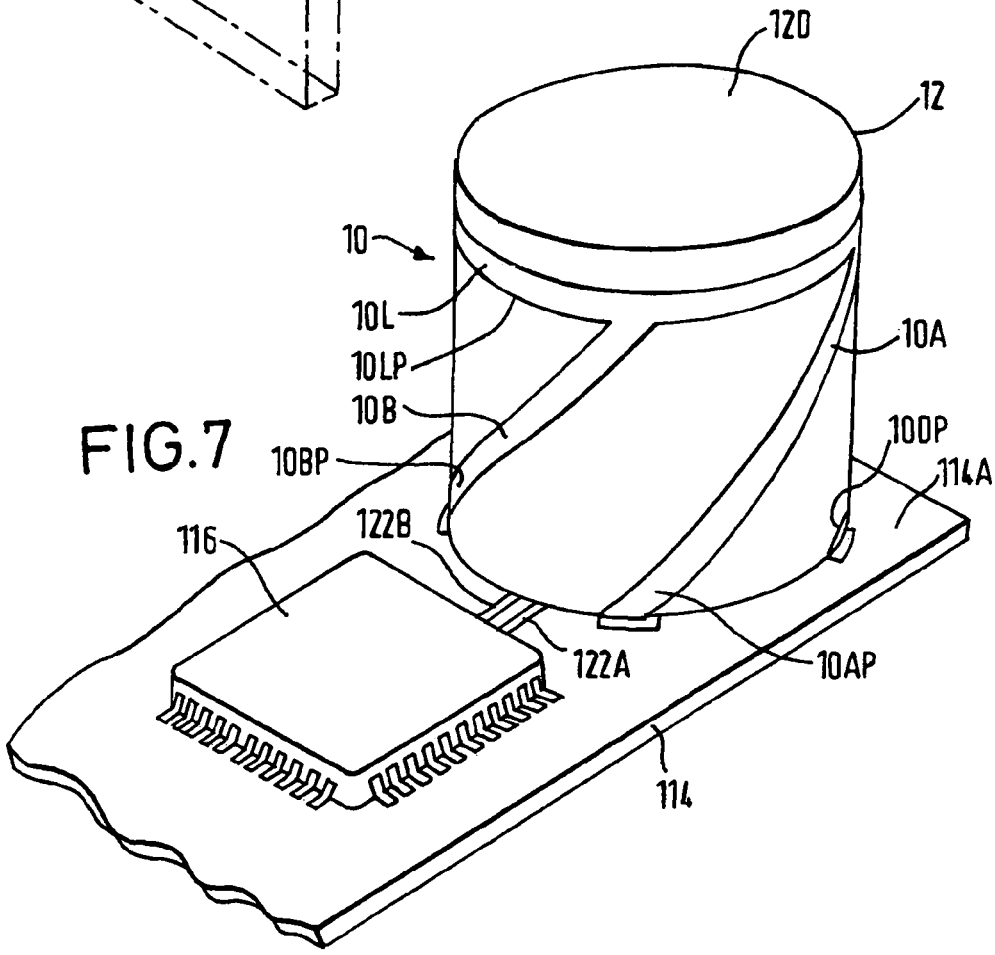
FIG. 7 is a fragmentary perspective view of a fourth antenna assembly in accordance with the invention, including a dielectrically-loaded endfire quadrifilar antenna secured to the face of a printed circuit board bearing an integrated receiver chip.
Figure 8:
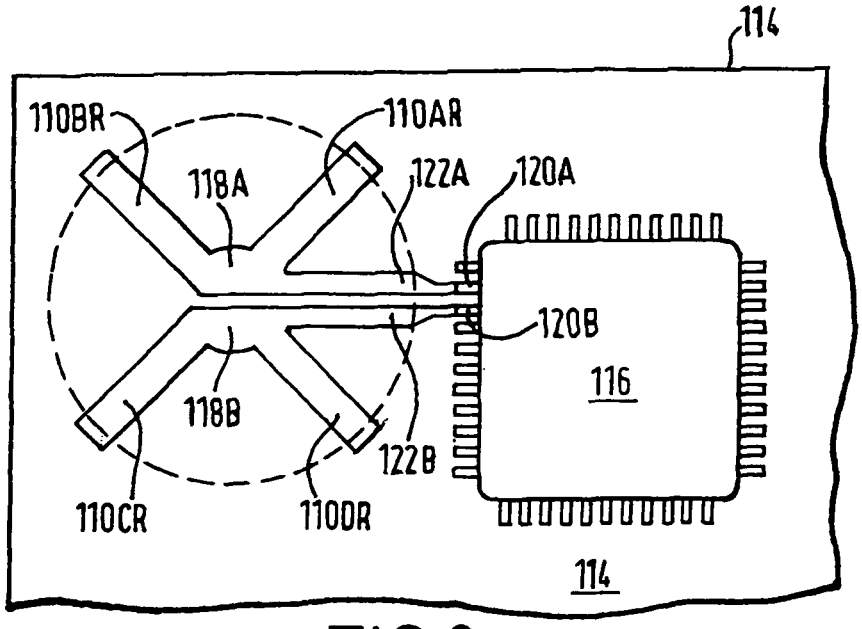
FIG. 8 is a fragmentary plan view of the printed circuit board and receiver chip of the assembly of FIG. 7.

Referring to FIGS. 7 and 8, in yet a further embodiment of the invention, the dielectrically-loaded helical antenna 10 is mounted upon a major face 114A of a printed circuit board 114 of a communication device. In this case, the antenna 10 is coupled to a surface-mounted VLSI integrated receiver circuit 116 which is also secured to the major face 114A of the board 114, feeder tracks 122A, 122B being plated on the board face 114A to interconnect feed connection nodes 118A, 118B associated with the antenna to input terminals 120A, 120B of the chip 116. In this example, the antenna 10 is a quadrifilar endfire antenna similar to that described above with reference to FIG. 1 with the exception that the radial conductors connected to the helical elements 10A-10D are formed as radial tracks 110AR, 110BR, 110CR, 10DR plated on the upper face 114A of the printed circuit board 114, as shown in FIG. 8. One pair of these radial tracks 110AR, 110BR is interconnected in a central region in registry with the axis of the antenna 10 to form a first feed connection node 118A. The other pair 110CR, 110DR is interconnected to form a second feed connection node 118B in the central region. Each of these nodes 118A, 118B is connected respectively to one of the feeder tracks 122A, 122B which extend as a parallel pair feeder from the central region to the input terminals 120A, 120B of the integrated receiver chip 16.

As in the above-described embodiments, the helical elements of the antenna 10 are quarter-turn elements. The conductive loops formed by the feeder tracks 122A, 122B, the radial conductors 110AR-110DR, the helical elements 10A-10D, and the linking conductor 10L (which has a non-planar edge 10LP as described above) form half wave loops at the operating frequency, the assembly exhibiting a quadrifilar resonant mode as hereinbefore described.

Connections between the helical elements 10A-10D and the respective radiating tracks 110AR-110DR may be made by conductive angle brackets (not shown) soldered to outer end portions of the radiating tracks that project beyond the periphery of the antenna 10 and to proximal end portions 10AP-10DP of the helical elements 10A-10D.

The integrated receiver chip 116 contains a differential amplifier input stage having a configuration shown in simplified form in FIG. 3. The chip 116 also contains most significant stages of a GPS receiver, including digital signal processing stages, using CMOS technology.

As before, the differential amplifier input stage presents a balanced high-impedance load matching the high source impedance of the combination of the antenna and the conductor pattern beneath the antenna on the printed circuit board face 114A.

Having a complete receiver on a single integrated circuit chip yields a particularly economical assembly. It will be understood that, although, in this embodiment, the antenna 10 is mounted with its proximal end face abutting the major surface of a printed circuit board 14 bearing the integrated receiver chip 116, is also possible to mount such a chip on a printed circuit board carrying an edge-mounted antenna, as shown in FIG. 1.

Figure 9:
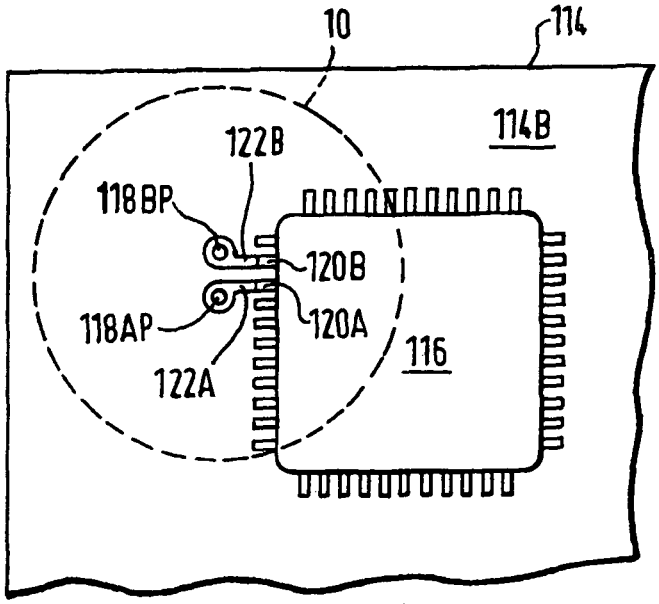
FIG. 9 is a fragmentary underside view of a fifth antenna assembly in accordance with the invention, including a printed circuit board with an integrated receiver chip mounted on the underside.

Referring to FIG. 9, a fifth antenna assembly in accordance with the invention has the integrated receiver chip mounted on the reverse face 114B of the equipment printed circuit board 114. The radial tracks connecting the helical elements 10A-10D to the feed connection nodes are formed either on the proximal end face of the antenna as in the embodiment described above with reference to FIG. 1, or on the upper face 114A of the printed circuit board 114, as described above with reference to FIG. 8. Mounting the integrated receiver chip on the reverse face 114B of the printed circuit board 114 allows significantly shorter feeder tracks 122A, 122B. In this embodiment, connections to the feed connection nodes are made by pins 118AP, 118BP housed in through-holes at the ends of the feeder tracks 112A, 112B, as shown in FIG. 9. During assembly, the pins 118AP and 118BP may be inserted and soldered in plated blind holes in the proximal surface portion of the antenna core to form first connections to radial conductive tracks such as tracks 10AR-10DR in the quadrifilar antenna of FIG. 1 on the bifilar antenna of FIG. 6. The antenna 10 is then offered up to the upper face of the amplifier board 114 and the pins are pushed into the through-holes and then soldered to the feeder tracks 122A, 122B.

What is claimed is:

1. A dielectrically loaded multifilar helical antenna for operation at a frequency in excess of 200 MHz, comprising: a dielectric core of a solid material having a relative dielectric constant greater than 5, the material of the core occupying the major part of the volume defined by the core outer surface, and a three-dimensional antenna element structure disposed on or adjacent an outer surface of the core having at least first and second pairs of elongate conductive substantially helical antenna elements centred on a common axis, each of which elements has a feed end and a linked end, the linked ends of each pair being linked together by a linking conductor, wherein the helical elements of the first said pair form part of a first conductive loop and the helical elements of the second said pair form part of a second conductive loop, and wherein, at an operating frequency at which the antenna is resonant in respect of axially directed circularly polarised radiation, each said conductive loop has an electrical length of substantially $(2n-1)/2$ times the wavelength, where n is an integer and wherein voltage maxima are present substantially at said feed end of each of said elements.

2. The antenna according to claim 1, wherein each of the said helical elements executes a quarter turn about the axis.

3. The antenna according to claim 2, comprising a balanced feed connection and a balanced feed structure.

4. The antenna according to claim 3, wherein the balanced feed structure is in the form of a parallel pair of wires or a twisted pair of wires.

5. The antenna according to claim 2, having a balanced feed connection and presenting a source impedance greater than 500 ohms.

6. The antenna according to claim 1, comprising a balanced feed connection and a balanced feed structure.

7. The antenna according to claim 6, wherein the antenna is a backfire antenna and the feed structure extends through the core.

8. The antenna according to claim 7, wherein the antenna is an endfire antenna.

9. The antenna according to claim 6, wherein the balanced feed structure is in the form of a parallel pair of wires or a twisted pair of wires.

10. The antenna according to claim 6, wherein the antenna is an endfire antenna.

11. The antenna according to claim 1, having a balanced feed connection and presenting a source impedance greater than 500 ohms.

12. The antenna according to claim 11, wherein the antenna is an endfire antenna.

13. An antenna assembly including a dielectrically loaded antenna as claimed in claim 1 and a receiver having a radio frequency (RF) front-end stage with a balanced input coupled to the antenna, the input impedance of the balanced input being at least 500 ohms.

14. The assembly according to claim 13, wherein the RF front-end stage comprises a differential amplifier.

15. The assembly according to claim 13, wherein the RF front-end stage comprises a surface-acoustic-wave (SAW) filter.

16. The assembly according to claim 15, wherein the SAW filter has a single-ended output.

17. The assembly according to claim 13, wherein the antenna has a cylindrical core having a cylindrical side surface portion and proximal and distal surface portions extending substantially perpendicularly to the side surface portion, and wherein the radio frequency front-end stage is a differential amplifier formed on a printed circuit board secured on or adjacent one of the proximal and distal surface portions.

18. The assembly according to claim 13, wherein:

the core has a side surface portion and proximal and distal surface portions extending substantially perpendicularly of the side surface portion;

the core has a cavity the base of which forms the proximal surface portion; and the radio frequency front-end stage is mounted in the cavity.

19. The assembly according to claim 13, including a conductive enclosure mounted to the core, wherein the radio frequency front-end stage has a single-ended output connection located inside the enclosure.

20. The antenna assembly including a dielectrically-loaded antenna as claimed in claim 1 and a differential amplifier coupled to the antenna wherein: the relative dielectric constant is greater than 15, the said antenna elements having a common axis and being axially coextensive on or adjacent an outer surface of the core; the antenna further comprises a feed connection having a pair of feed connection nodes each coupled to a respective one or more of the antenna elements at their feed ends; and the differential amplifier has a differential input with a pair of input terminals each of which is coupled to a respective one of the feed connection nodes.

21. The assembly according to claim 20, wherein: the core has a side surface portion with which the antenna elements are associated, and a passage extending through the core from a distal core surface portion to a proximal core surface portion; the feed connection nodes are associated with the distal surface portion; and the assembly further comprises a parallel-pair feeder extending through the passage from the feed connection nodes to the differential amplifier.

22. The assembly according to claim 21, wherein the differential amplifier is located on a printed circuit board to which the core is secured at its proximal surface portion.

23. The assembly according to claim 20, wherein the core has a side surface portion with which the antenna elements are associated, and a distal surface portion and a proximal surface portion each extending transversely with respect to the common axis, and wherein the differential amplifier is located on a printed circuit board to which the core is secured at its proximal surface portion.

24. The assembly according to claim 23, wherein the printed circuit board is a planar board lying parallel to or on the common axis.

25. The assembly according to claim 20, wherein the feed connection nodes are located on or adjacent the common said axis and on an outer surface portion of the core, the helical antenna elements being coupled to the feed connection nodes by respective radial conductors on the said outer surface portions.

26. The assembly according to claim 20, wherein each of the helical antenna elements executes (2P−1)/4 turns around the said axis, where P is an integer.

27. The assembly according to claim 20, wherein the source impedance presented to the said differential input is greater than or equal to 500 ohms.

28. The assembly according to claim 20, wherein the source presented to the said differential input is a balanced source.

29. The assembly according to claim 20, wherein the differential amplifier has a single-ended output.

30. The assembly according to claim 20, having four quarter-turn helical antenna elements sharing a single axis which is the said common axis.

31. An antenna assembly including a dielectrically-loaded antenna as claimed in claim 1 and a surface acoustic wave (SAW) filter element coupled to the antenna wherein: the relative dielectric constant is greater than 15, the said antenna elements having a common axis and being axially coextensive on or adjacent an outer surface of the core; the antenna further comprises a feed connection having a pair of feed connection nodes each coupled to a respective one or more of the antenna elements at their feed ends; and the SAW filter element has a balanced input with a pair of input terminals each of which is coupled to a respective one of the feed connection nodes.

32. The assembly according to claim 31, wherein: the core has a passage extending therethrough from a distal core surface portion to a proximal core surface portion; the feed connection nodes are associated with the distal surface portion; and the assembly further comprises a parallel-pair feeder extending through the passage from the feed connection nodes to the SAW filter element.

33. The assembly according to claim 32, wherein the SAW filter element is located on a printed circuit board to which the core is secured at its proximal surface portion.

34. The assembly according to claim 31, wherein the core has a side surface portion with which the antenna elements are associated, and a distal surface portion and a proximal surface portion each extending transversely with respect to the common axis, and wherein the SAW filter element is located on a printed circuit board to which the core is secured at its proximal surface portion.

35. The assembly according to claim 34, wherein the printed circuit board is a planar board lying parallel to or on the common axis.

36. The assembly according to claim 31, wherein the feed connection nodes are located on or adjacent the common said axis and on an outer surface portion of the core, the helical antenna elements being coupled to the feed connection nodes by respective radial conductors on the said outer surface portions.

37. The assembly according to claim 31, wherein each of the helical antenna elements executes (2P−1)/4 turns around the said axis, where P is an integer.

38. The assembly according to claim 31, wherein the source impedance presented to the said balanced input is greater than or equal to 500 ohms.

39. The assembly according to claim 31, wherein the SAW filter element has a single-ended output.

40. The assembly according to claim 31, having four quarter-turn helical antenna elements sharing a single axis which is the said common axis.

41. An antenna assembly for operation at a frequency in excess of 200 MHz comprising: a dielectrically-loaded antenna having a dielectric core of a solid material having a relative dielectric constant greater than 5, the material of the core occupying the major part of the volume defined by the core outer surface, and a three-dimensional antenna element structure disposed on or adjacent an outer surface of the core having at least a pair of laterally opposed elongate conductive antenna elements centred on a common axis, each of which elements has a feed end and a linked end, the linked ends of the said pair being linked together; and a radio frequency front-end element having a balanced input coupled to the feed ends of the elements of the said pair; wherein, at an operating frequency at which the antenna is resonant, the antenna elements of the said pair form part of a conductive loop having an electrical length of substantially (2n−1)/2 times the wavelength, where n is an integer and wherein voltage maxima are present substantially at said feed end of each of said elements.

42. The assembly according to claim 41, wherein the antenna element structure comprises at least one pair of helical elongate conductive elements, the front-end element having a first input coupled to one of the helical elements and a second input coupled to the other of the helical elements.

43. The assembly according to claim 41, wherein the core outer surface has distal and proximal surface portions extending generally transversely with respect to the axis and a side surface portion surrounding the axis and extending between the distal and proximal surface portions.

44. The assembly according to claim 43, wherein the antenna is a backfire antenna having a balanced feed structure passing through the core between the distal and proximal surface portions.

45. The assembly according to claim 41, wherein the front-end element comprises a differential amplifier.

46. The assembly according to claim 41, wherein the front-end element comprises a surface acoustic wave (SAW) filter device.

47. The assembly according to claim 46, wherein the SAW filter element is a SAW filter balun.

* * * * *